United States Patent [19]

Akesson

[11] Patent Number: 4,547,917

[45] Date of Patent: Oct. 22, 1985

[54] WATER CLOSET SYSTEM HAVING A LIQUID SEPARATOR

[76] Inventor: Torsten Akesson, Nypontunet 22, S-181 48 Lidingö , Sweden

[21] Appl. No.: 606,759

[22] Filed: May 3, 1984

[30] Foreign Application Priority Data

May 11, 1983 [SE] Sweden ..... 8302710

[51] Int. Cl.[4] ..... E03D 1/00; E03D 3/00; E03D 5/00

[52] U.S. Cl. ..... 4/300; 4/317; 4/318; 4/321; 210/513; 210/533

[58] Field of Search ..... 4/300, 317, 318, 319, 4/321, 323, 661; 210/532.1, 532.2, 533, 513, 299

[56] References Cited

U.S. PATENT DOCUMENTS

| | | | |
|---|---|---|---|
| 1,224,913 | 5/1917 | Ferguson | 4/321 X |
| 1,303,358 | 5/1919 | Montgomery | 4/317 X |
| 3,629,099 | 12/1971 | Gahmberg | 4/321 X |
| 3,829,909 | 8/1974 | Rod et al. | 4/318 |
| 3,922,730 | 12/1975 | Kamper | 4/318 X |
| 4,097,381 | 6/1978 | Ritzler | 210/513 X |
| 4,222,130 | 9/1980 | Roberts | 4/318 X |
| 4,313,233 | 2/1982 | Roberts | 4/318 X |
| 4,492,635 | 1/1985 | Stigebrandt | 210/533 X |

*Primary Examiner*—Henry K. Artis
*Attorney, Agent, or Firm*—McCormick, Paulding & Huber

[57] ABSTRACT

A water closet system comprising a lavatory which is connected to a collection tank or mouldering chamber (2) over a discharge piping (3), and a liquid separator (4) interconnected in said discharge piping (3) adjacent and above the tank or chamber (2). The liquid separator (4) comprises an inlet pipe (8) having a widened bottom portion (13), an outlet pipe (9) preferably having a widened top portion (14) and a liquid container which sealingly encloses at least the end portions (13, 14) of said inlet and outlet pipes (8, 9). The diameter (D2) of the top end (14) of the outlet pipe (9) is equal to of larger than the diameter (D1) of the non-widened portion of the inlet pipe (8), and the said diameter (D3) of the bottom end (13) of the inlet pipe (8) is larger than said diameter (D2) of the top portion (14) of the outlet pipe (9). The discharge piping (3) may be connected peripherally to the inlet pipe (8) of the liquid separator, and the inlet pipe (8) may have several wires provided spaced round the periphery thereof and extending down towards the center of the outlet pipe (9) for guiding solid and semi-solid material received from the inlet pipe (8) to the center of the outlet pipe (9).

7 Claims, 5 Drawing Figures

WATER CLOSET SYSTEM HAVING A LIQUID SEPARATOR

The present invention generally relates to water closet systems, and is more particularly concerned with a water closet system, of the closed or non-drained type and having a liquid separator, providing improved possibilities of using water closets in systems having a lavatory connected to a moldering chamber of a closed collection tank which may be emptied occasionally.

Previously known closed type water closet systems in which a lavatory is connected to a collection tank generally have utilized lavatories of the lean-flushing type consuming a relatively small amount of flushing liquid, for instance, three liters of liquid for each flushing. Even such a small amount of flushing liquid has necessitated the installation of very large collection tanks or moldering chambers for the purpose of extending the necessary time intervals for emptying each system's tank or chamber.

In toiler systems of the moldering type the amount of liquid also must be restricted so that the moldering process can proceed. Therefore, the lavatory, which normally is of the type including an open pipe, must be placed straight above the moldering chamber so that the material, including feces, paper, urine, etc., can fall freely down into the moldering chamber. The placing of the lavatory straight above the moldering chamber has led to installation problems. A further disadvantage is that odors and insects may enter the toilet room from the moldering chamber.

To have a toilet flushing system work, it is necessary to use a certain least amount of flushing liquid for transporting the solid or semi-solid material such as feces, paper, etc. through the discharge pipes. The necessary amount of liquid is partly dependent on the inclination of the pipe system.

The invention is based on the observation that liquid flowing in an inclined, and also in a vertical, pipe mainly follows the inner walls of the pipe, even if the walls of the pipe are curved, supposing only that the flow of liquid is small in relation to the total capacity of the pipe, whereby the pipe provides a sufficiently large wall area.

One object of the invention is to utilize conventional or lean flushing lavatories and drains for transporting any material from the lavatory and as far as to the tank or the moldering chamber, and to separate most of the liquid from the combined material before the solid or semi-solid material is passed to the tank or the moldering chamber. The separated liquid may then be drained to an infiltration apparatus or to any other type of drainage, or it may be recirculated in the water closet system.

Another object of the invention is to make it possible to install the lavatory, on one hand, and the collection tank or moldering chamber, on the other hand, spaced from each other, preferably so that the tank or moldering chamber is located to one side of the lavatory and on a lower level than the lavatory.

A still further object of the invention is to provide a lavatory room wherein a good sanitary standard is maintained by using a water closet even though the system may be one of the moldering chamber type.

The invention will now be described in more detail with reference to practical embodiments thereof as shown in the accompanying drawings. It is, however, to be understood that the invention is not restricted to the herein described and illustrated embodiments, and that many modifications may be presented within the scope of the appended claims.

DESCRIPTION OF THE PREFERRED EMBODIMENT

Figure 1:
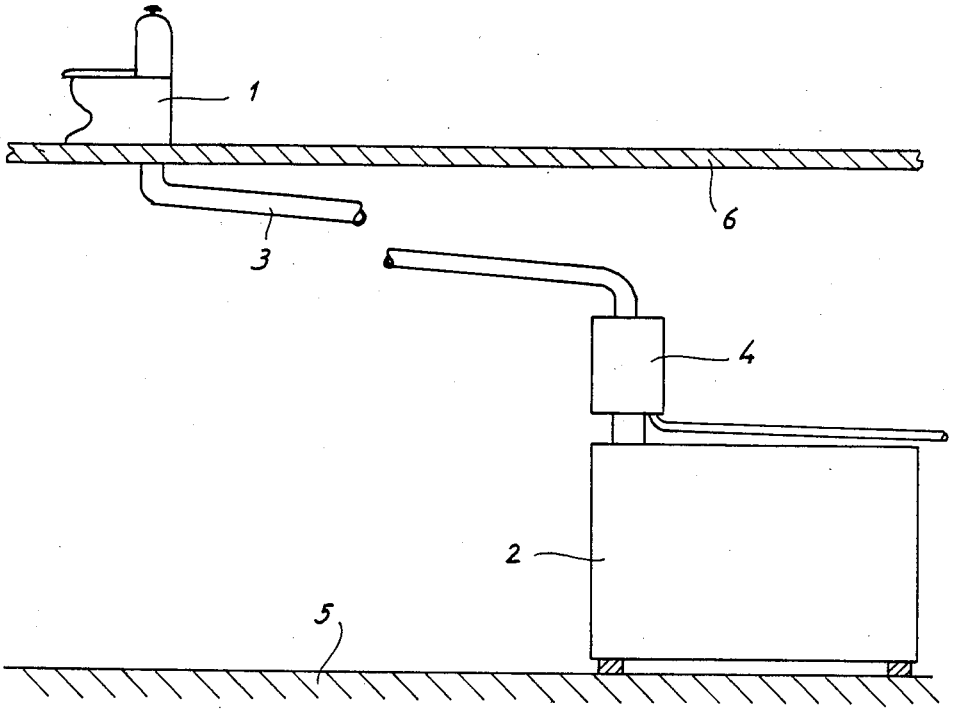
FIG. 1 is a diagrammatic elevational view of a first embodiment of a toilet system according to the invention.
Figure 2:
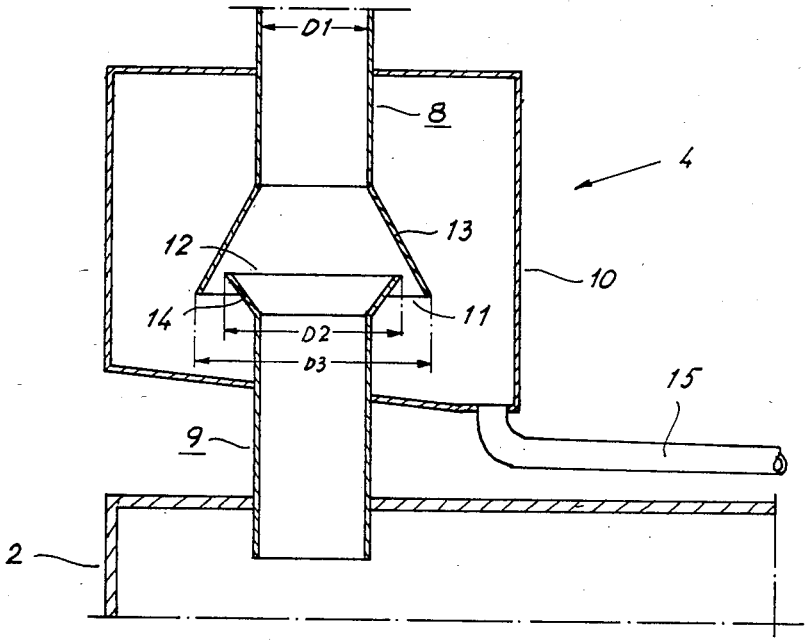
FIG. 2 is a vertical cross sectional view of a liquid separator included in the toilet system of FIG. 1.

The embodiments of the invention shown by the drawings generally comprise a lavatory 1 which is connected to a collection tank or a moldering chamber through a discharge pipe 3 having a liquid separator 4 interconnected therewith.

The collection tank or moldering chamber 2 is mounted on a lower level than the level of the lavatory 1 and is also preferably located to one side of the lavatory. For example, the lavatory 1 may be mounted on the floor 6 of a building and the tank or chamber 2 placed on a subfloor or on the ground 5 underneath the building floor 6. By placing the tank or chamber 2 to one side of the lavatory, it is possible to locate the lavatory and/or the tank or chamber at any suitable place in the building. It is also possible to place the tank or chamber 2 directly underneath the lavatory, but in such case, the discharge pipe 3' preferably is formed with an S-turn 7, as indicated with the dotted lines in FIG. 3, to make sure that the liquid from the lavatory mainly follows the inner surface of the pipe. The pipe 3 or 3' generally has to be mounted inclined, as known in the case of drains.

The liquid separator 4 interconnected with the discharge pipe 3 is mounted in a vertical position above and adjacent the tank or chamber 2. It comprises an inlet pipe 8 directly connected to the discharge pipe 3 from the lavatory 1, an outlet pipe 9 directly connected to the tank or chamber 2, and a liquid container 10 sealingly enclosing the outlet end 11 of the inlet pipe 8 and the inlet end 12 of the outlet pipe 9. The lower or outlet end of the inlet pipe 8 is widened to a cone 13 or to a similar means, and preferably the upper or inlet end 12 of the outlet pipe 9 is also widened to a cone 14 or similar means. The inlet and outlet pipes 8 and 9 extend co-axially with the upper end 12 of the outlet pipe 9 being located above the outlet end 11 of the inlet pipe.

Preferably the discharge pipe 3, the liquid separator 4 with the inlet and outlet pipes 8 and 9, and the liquid container 10 and the tank or chamber 2 are in sealed connection with each other to prevent odor from leaving the system. As usual, the system may be evacuated by a chimney-like pipe.

The solid or semi-solid material received from the lavatory 1 via the discharge pipe 3 and leaving the inlet pipe 8 of the separator falls directly and freely down into the collection tank or moldering chamber 2 over the outlet pipe 9, whereas the liquid follows the inner surface of the discharge pipe 3 and the inlet pipe 8 of the separator 4 and drops down to the bottom of the liquid container 10 from the outlet edge 11 of the cone portion 13 of the inlet pipe 8 outside of the inlet edge 12 of the outlet pipe 9.

According to the invention, the diameter of the inlet edge 12 of the outlet pipe 9 is less than the diameter of the outlet edge 11 of the inlet pipe 8, and also the diameter of the main portion of the inlet pipe 8 is less than or equal to the diameter of the inlet edge 12 of the outlet pipe 9. Expressed in terms as marked in FIG. 4, this means $D1 \leqq D2 \leqq D3$.

Preferably the bottom of the liquid container is downwardly inclined to an outlet 15 through which the liquid is drained continuously or intermittently. The liquid leaving the outlet 15 of the container 10 is passed to an infiltration chamber or to any other type of draining means, or it may be recirculated to the lavatory, possibly after passing an preliminary filtering or sedimentation unit (not illustrated).

It is presupposed that the amount of liquid, including the flushing liquid received from the lavatory, is small compared to the capacity of the discharge pipe, and therefore the liquid mainly follows the bottom surface of the discharge pipe 3 and is distributed over the entire inner surface of the inlet pipe 8 of the liquid separator 4. Therefore, the end of the pipe 3 connected to the separator may even be vertical as shown in FIG. 1.

Figure 3:
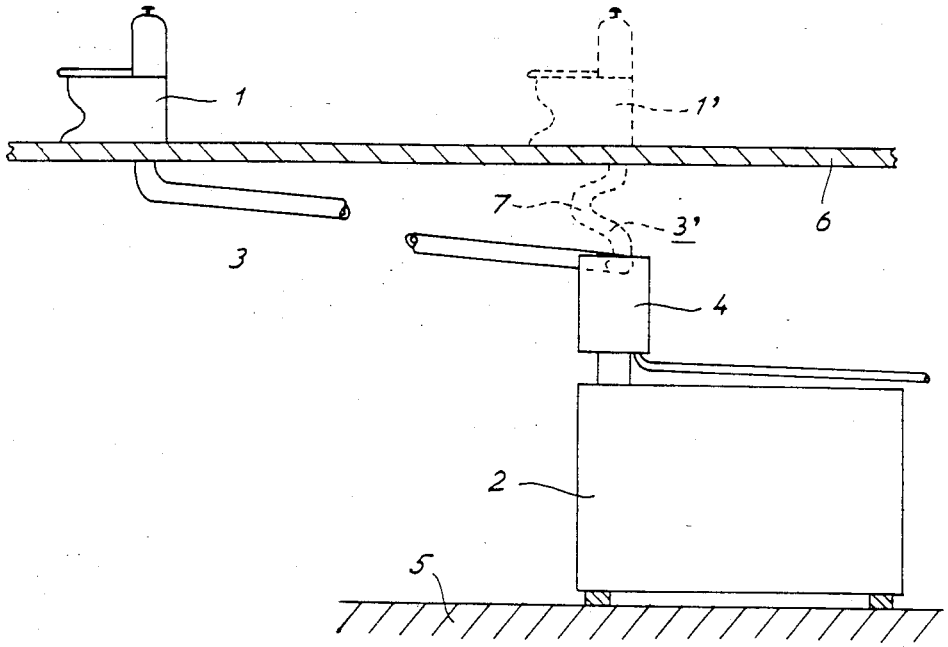
FIG. 3 is an elevational view of a modified embodiment of a toilet system according to the invention.
Figure 5:
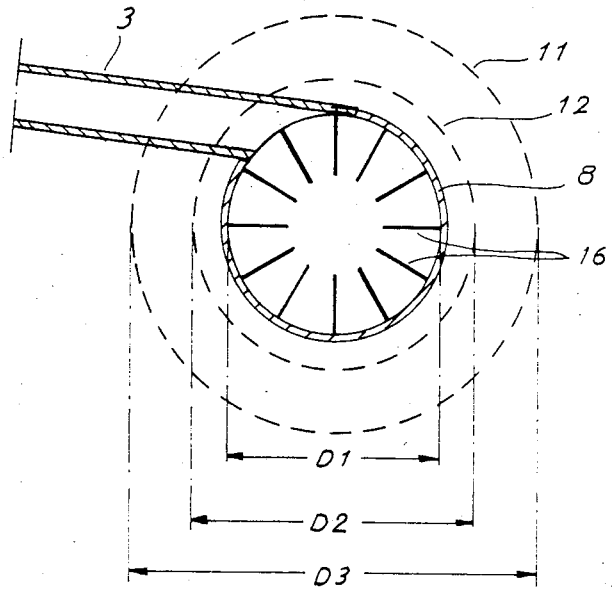
FIG. 5 is a cross sectional view taken on the line V—V of FIG. 4.
Figure 4:
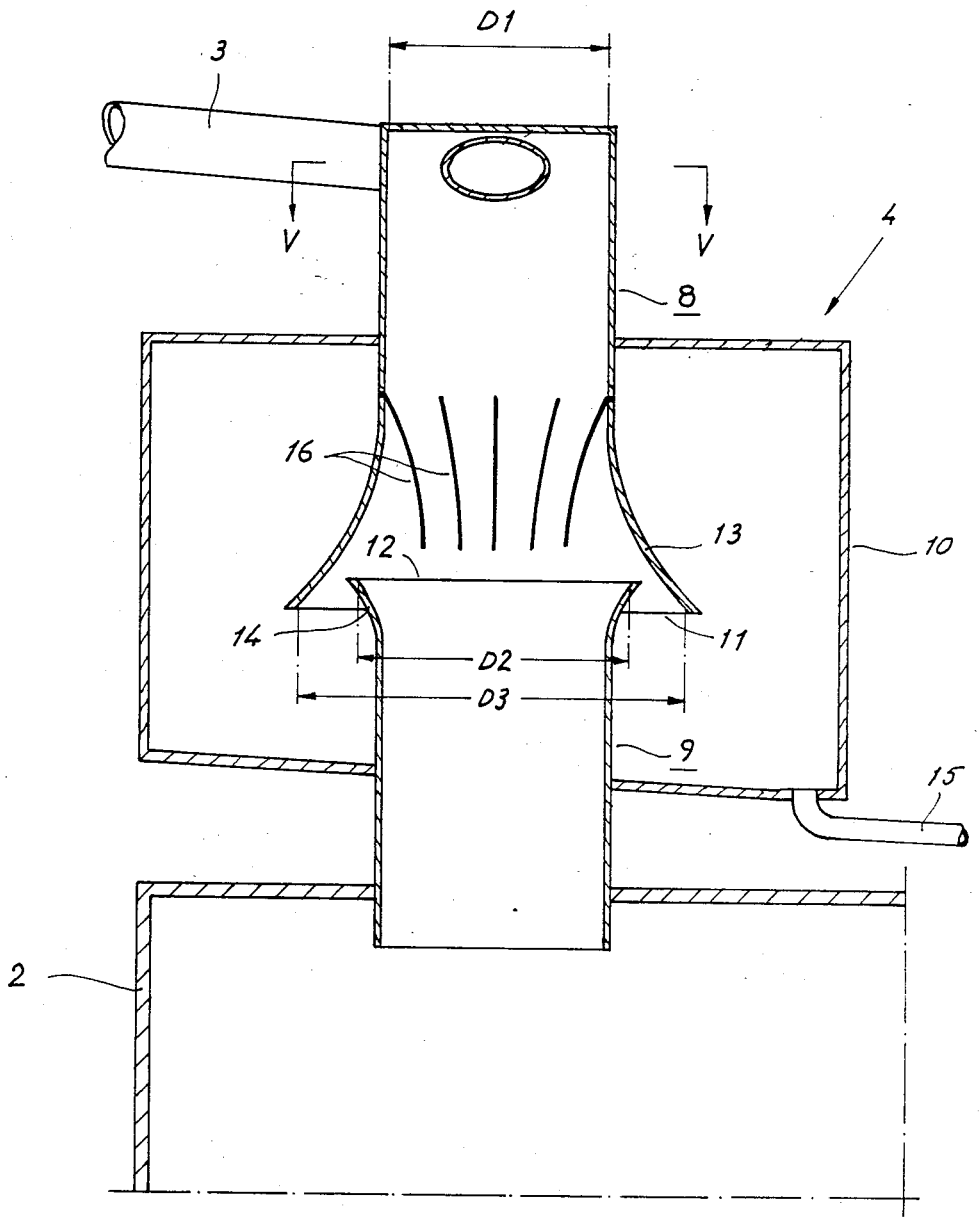
FIG. 4 is a vertical cross sectional view through a liquid separator included in the toilet system of FIG. 3.

In special cases, for instance when using short discharge pipes 3' between the lavatory 1 and the tank or chamber 2, it may be suitable to connect the discharge pipe 3 peripherally as shown in FIGS. 3–5 of the drawings, whereby the liquid is brought to flow in spiral form inside the inlet pipe 8. Still the solid and semi-solid materials, which are heavier, drop straight down through the outlet pipe 9 to the tank or chamber 2. In order to make sure that no solid or semi-solid material is passed over to the liquid container 10, guide wires 16, preferably spring wires, may be mounted in spaced relation to one another around the periphery of the inlet pipe 8 of the separator 4 and extending down toward the center of the outlet pipe 9 from a level above the cone portion 13.

In the above description, the inlet 8 and outlet 9 of the liquid separator 4 have been characterized as pipes. Of course, said inlet and outlet may be be means other than a pipe and may each have a shape other than that of a cylindrical pipe, as will be obvious to the expert.

I claim:

1. A water closet system comprising a lavatory, a collection tank or a mouldering chamber and a discharge pipe between said lavatory and tank or chamber, characterized in that said discharge pipe is sized in relation to the amount of liquid normally flowed therethrough so that said amount of liquid normally flowed therethrough is small in relation to the total capacity of said pipe whereby said normal amount of liquid flow through said pipe will tend to follow the inner wall of said pipe, a liquid separator means interconnected in said discharge pipe extending between the lavatory and collection tank or mouldering chamber and adapted to separate any liquid from the combined material received from the lavatory and comprising an inlet pipe provided below the lavatory and connected to the discharge pipe and an outlet pipe connected to said tank or mouldering chamber, the lower edge of said inlet pipe being widened, the upper edge of said outlet pipe being of at least the same cross section area as the non-widened portion of the inlet pipe, and the widened edge of said inlet pipe being of at least the same cross section area as said upper edge of the outlet pipe.

2. A water closet system according to claim 1, characterized in that said liquid separator is mounted to one side of said lavatory, and in that said discharge pipe is connected to said inlet pipe of the liquid separator through at least some inclined portion of said discharge pipe.

3. A water closet system according to claim 1 characterized in that said discharge piping is connected substantially peripherally to said inlet pipe of said liquid separator.

4. A water closet system according to claim 1, characterized in that said liquid separator is mounted to one side of said lavatory, in that said discharge pipe is connected to said inlet pipe of said liquid separator over at least some inclined portion of said discharge pipe, and in that said discharge pipe is connected substantially peripherally to said inlet pipe of said liquid separator.

5. A water closet system according to claim 1 characterized in that both said lower end of said inlet pipe and said upper end of said outlet pipe of said liquid separator are conically widened.

6. A liquid separator according to claim 1 characterized in that said lower end of said inlet pipe and said upper end of said outlet pipe of said liquid separator are sealingly enclosed in a liquid container having an outlet for draining therefrom the liquid received from the lower edge of said widened portion of said inlet pipe.

7. A liquid separator according to claim 1 characterized in that said inlet pipe of said liquid separator includes wires mounted around the periphery of said inlet pipe in spaced relation to one another and extending obliquely downward and toward the center of said outlet pipe for guiding solid or semisolid material passing said inlet pipe toward the center of said outlet pipe.

* * * * *